US005139168A

United States Patent [19]

Gueret

[11] Patent Number: 5,139,168

[45] Date of Patent: Aug. 18, 1992

[54] ASSEMBLY FOR DISPENSING A PRODUCT IN WHICH THE PRODUCT TO BE DISPENSED IS CONTAINED IN A FLEXIBLE POUCH

[75] Inventor: Jean-Louis Gueret, Paris, France

[73] Assignee: L'oreal, Paris, France

[21] Appl. No.: 654,092

[22] Filed: Feb. 13, 1991

[30] Foreign Application Priority Data

Feb. 28, 1990 [FR] France ..... 90 02500

[51] Int. Cl.[5] ..... B65D 35/00

[52] U.S. Cl. ..... 222/92; 222/105; 222/564

[58] Field of Search ..... 222/95, 105, 183, 386.5, 222/464, 564, 92

[56] References Cited

U.S. PATENT DOCUMENTS

| | | | |
|---|---|---|---|
| 2,133,411 | 10/1938 | Zohe | 222/105 |
| 3,388,832 | 6/1968 | Stewart et al. | 222/386.5 |
| 3,389,833 | 6/1968 | Ramis | 222/95 |
| 3,404,813 | 10/1968 | Waxman | 222/386.5 |
| 3,412,937 | 11/1968 | Chamberlain | 222/564 |
| 4,013,195 | 3/1977 | Ferris | 222/386.5 |
| 4,044,912 | 8/1977 | Nichols | 222/95 |
| 4,148,416 | 4/1979 | Gunn-Smith | 222/564 |
| 4,381,346 | 5/1983 | Heck | 222/95 |
| 4,524,458 | 6/1985 | Pongrass et al. | 222/105 |
| 4,949,871 | 8/1990 | Flanner | 222/386.5 |
| 5,004,123 | 4/1991 | Stoody | 222/105 |

FOREIGN PATENT DOCUMENTS

| | | | |
|---|---|---|---|
| 0156627 | 10/1985 | European Pat. Off. . | |
| WO-A-8504383 | 3/1985 | PCT Int'l Appl. . | |
| 755624 | 8/1956 | United Kingdom | 222/95 |
| 1165400 | 9/1969 | United Kingdom | 222/95 |

OTHER PUBLICATIONS

European Search Report-Oct. 1990.

*Primary Examiner*—Michael S. Huppert
*Assistant Examiner*—Kenneth Bomberg
*Attorney, Agent, or Firm*—Cushman, Darby & Cushman

[57] ABSTRACT

The flexible pouch (2) contains a semi-rigid component (6). The relative dimensions of the pouch (2) and the semi-rigid component (6) are such that the component (6) cannot move into a position in which its median plane would be perpendicular to the output axis of the product being dispensed. The component (6) can be free or fixed to the outlet pipe for the product to be dispensed. The component (6) defines flow channels for the product being dispensed from the bottom of the container towards the outlet pipe for the product.

28 Claims, 3 Drawing Sheets

ASSEMBLY FOR DISPENSING A PRODUCT IN WHICH THE PRODUCT TO BE DISPENSED IS CONTAINED IN A FLEXIBLE POUCH

This invention relates to an assembly for dispensing a product in which the product to be dispensed is contained in a flexible pouch.

Assemblies of this kind are used more particularly in cases where the distributor head, associated with the flexible pouch, forms a pump without recirculation of air or in the case of dispensers of the aerosol type in which the product is introduced into a flexible pouch and the propellent is introduced into the can around the pouch.

The flexible pouches usually consist of a bag comprising two walls of variable shape, e.g. rectangular, the walls being welded at least on one side. The flexible pouch is fixed in a sealed manner, usually by means of welding, to a distributor head. As the product is dispensed, the flexible pouch gradually empties and, consequently, its walls draw together. Therefore, the two walls often come into contact with one another before all of the product has been dispensed and stick together over one or several zones, wherein the said zones can then form an impenetrable barrier. Part of the product to be dispensed can be trapped in this manner, so that it becomes impossible to dispense it. Losses as a result of the product being trapped in this manner can be quite considerable. U.S. Pat. No. 4,381,846 proposes introducing a mesh screen into the flexible reservoir, which, during the flow of the product, moves from a first position, in which it can be displaced freely, to a second position, in which it covers the output orifice for the product to be dispensed and prevents the walls of the reservoir from being sucked into the output orifice. The liquid can then pass freely through the mesh screen and flow through the output orifice. This prevents the output orifice being blocked by aspiration of the walls of the reservoir. With this device, it is not possible to prevent the lateral walls of the flexible reservoir from sticking together. Consequently, part of the product may still remain trapped.

In order to mitigate this disadvantage, according to this invention, a screen which is parallel to the output axis of the liquid and which remains parallel to this axis is introduced into the flexible pouch.

Therefore, the object of this invention is an assembly for dispensing a product in which the product to be dispensed is contained in a flexible pouch fixed to a distributor head and comprising a pipe for the outflow of the product from the pouch, the flexible pouch containing an internal component, characterised in that the internal component is a semi-rigid component, the median plane of which is substantially parallel to the output axis of the product being dispensed, that the relative dimensions of the pouch and the component are such that the said component remains in its position and cannot move into a position in which its median plane would be perpendicular to the output axis of the product being dispensed, and that the component defines flow channels for the product being dispensed, directed towards the outlet pipe for the product.

By virtue of the component disposed in this manner, it is possible to keep the walls of the flexible pouch at a distance from one another, so as to prevent them from sticking together and forming an impenetrable barrier blocking the flow of part of the product to be dispensed towards the outlet pipe for the product.

According to the invention, the component is a semi-rigid component, so that it cannot twist or bend, e.g. form a spiral, as the flow of the product to be dispensed would be disrupted.

The semi-rigid component can cover a larger or smaller surface of the median plane of the flexible pouch, in so far as its dimensions do not allow it to move into a position perpendicular to the output axis of the product being dispensed.

The semi-rigid component preferably covers only part of this median plane. This arrangement facilitates the introduction of the component into the said flexible pouch. In addition, when the component is free, it can be displaced slightly within the flexible pouch, so that it is possible to mix the product, if necessary, to break its thixotropy, and to prevent the formation of preferential channels. In particular, the component is preferably shorter than the pouch. In this manner, the pouch can shorten and lie flat under the distributor head, so that the pouch can be emptied completely.

The component may be free in the flexible pouch. It is preferably fixed to the outlet pipe for the product. In this manner, there is always a connection between the component and the output orifice for the product and this prevents any risk of an impenetrable barrier forming between the component and the output orifice as a result of the walls of the pouch sticking together. The device for fixing the component is preferably movable in flexion and/or in rotation relative to the outlet pipe for the product. This gives the component improved resistance against deformation of the pouch.

The fixing device advantageously comprises a hollow ball. The ball therefore allows for both the passage of the product and rotational displacement of the component.

The semi-rigid component can be cast in one piece with the outlet pipe for the product or with the fixing device.

According to a first embodiment, the semi-rigid component is a screen. Its longitudinal and transverse elements are preferably rectilinear and perpendicular, the longitudinal elements preferably being parallel to the longitudinal axis of the pouch.

The longitudinal and transverse elements of the screen are advantageously disposed in two parallel planes, i.e. they intersect and are welded to one another without interpenetration. The longitudinal and transverse elements can also have corrugations in planes perpendicular to the median plane of the screen. The transverse and longitudinal elements may also be woven in some manner.

The periphery of the screen is preferably provided with beading adapted to prevent the risk of the ends of the longitudinal and transverse elements of the screen piercing the wall of the pouch.

The mesh size of the screen is sufficiently small that the walls of the pouch cannot stick together inside the meshwork. The largest possible dimension is therefore a function of the rigidity of the walls of the pouch and of the viscosity of the product being dispensed. This dimension is generally between 1.5 and 20 $mm^2$, e.g. approximately 9 $mm^2$.

According to a second embodiment, the component consists of semi-rigid strips separated by slots and connected together at their ends, the strips being curved at one side or the other of the median plane of the component, two adjacent strips being curved in opposite directions.

In this embodiment, the curved strips keep the walls of the bag at a distance from one another. As the pouch empties, the walls of the pouch press with increasing force against the curved strips. The latter, having a certain degree of flexibility, are deformed in the direction of the median plane of the component. This facilitates dispensing of the product remaining in the pouch.

According to one particular embodiment of the assembly according to the invention, a device forming a capillary system is fixed in the vicinity of the orifice of the outlet pipe between the component and the said pipe, perpendicular to the said screen. This device has, in particular, an annular shape. It can be solid and can comprise channels or ribs on the product side. It may also consist of a screen.

This device complements the action of the screen.

The object of the invention will be more readily understood from the following description, given purely by way of a nonlimiting example, of several embodiments, illustrated in the accompanying drawings, in which.

Figure 1:
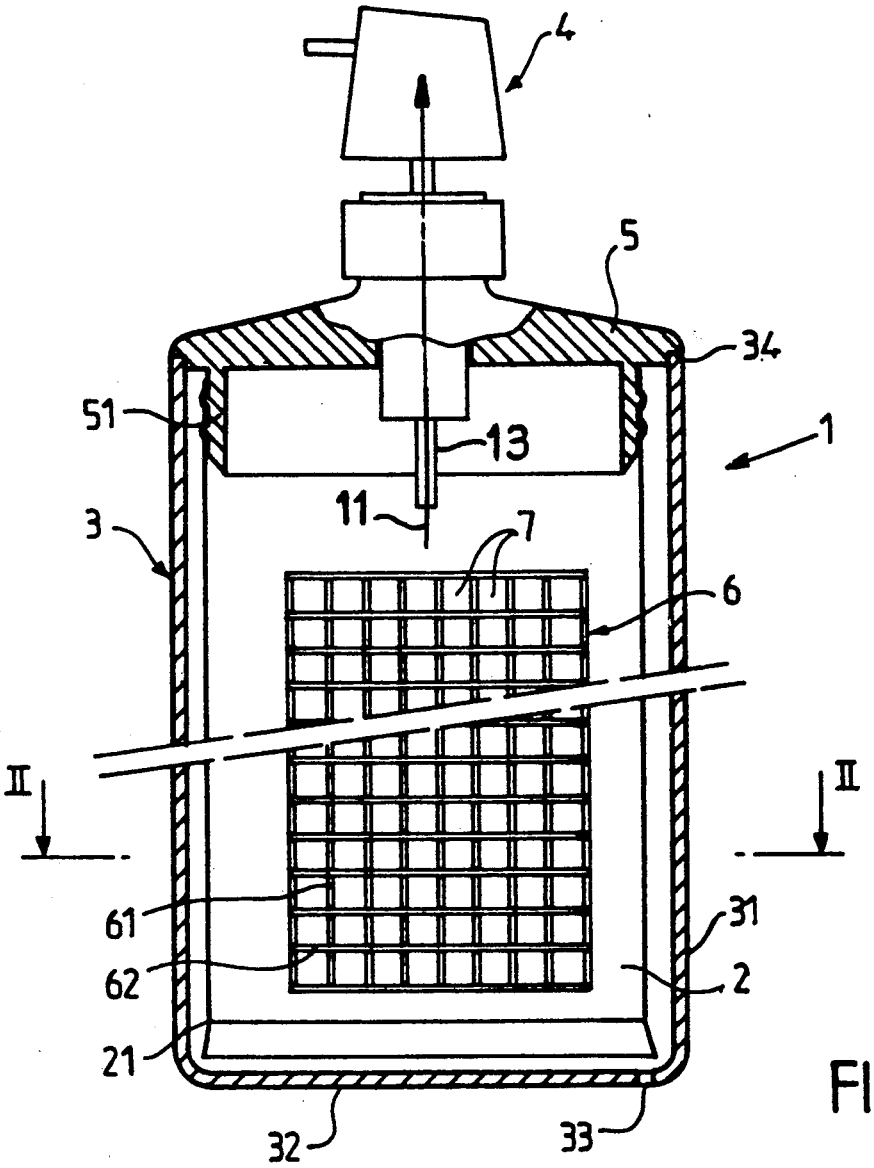
FIG. 1 is a partly external view and partly sectional view of a dispenser assembly according to the invention.
Figure 2:
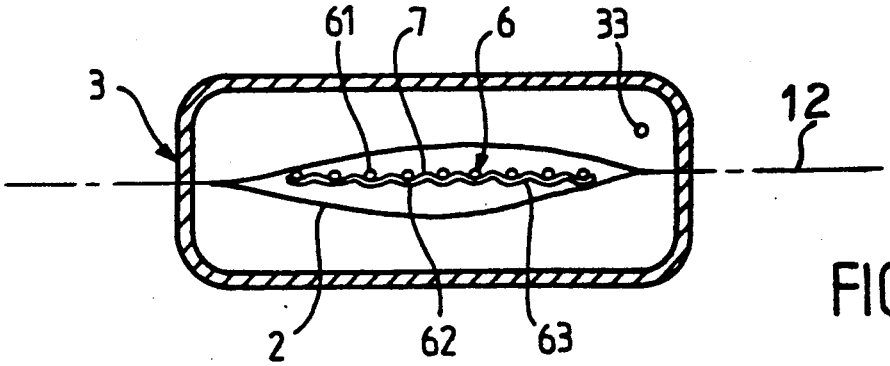
FIG. 2 is a transverse section of this same assembly along the line II—II of FIG. 1.

The dispenser assembly according to the invention illustrated in FIGS. 1 and 2 is designated in general by the reference numeral 1. It comprises a flexible pouch 2 contained in a rigid enclosure 3 and a distributor head 4 mounted on a cap 5, the flexible pouch containing a free screen 6 as a semi-rigid component. The rigid enclosure 3 has, e.g. a cylindrical shape, and comprises a lateral wall 31 and a base 32. An air inlet opening 33 is formed in this base 32. The cap 5 is fitted into the upper edge 34 of the rigid enclosure 3. On its face directed towards the rigid container 3, the cap 5 has a cylindrical skirt 51, the flexible pouch 2 being welded to the external wall thereof; particularly by means of rotary ultrasonic welding. This pouch 2 consists of a tube of flexible plastic material closed at its lower part by a welding seam 21. The cap 5 comprises a neck (13) to which the distributor head 4 is fixed by screwing or by snap engagement, said distributor head 4 forming a pump comprising two valves and without recirculation of air.

The flexible pouch 2 contains a screen 6 having two-directional meshes and made of flexible plastic material. This screen 6, e.g. a square meshed screen, consists, as can be seen in FIG. 2, of longitudinal elements 61 and transverse elements 62 situated in two parallel planes, i.e. they intersect and are welded to one another without interpenetration. The longitudinal elements 61 and transverse elements 62 have regular corrugations 63, as shown in FIG. 2. This screen has smaller dimensions than those of the bag, so that it is possible for it to be displaced within the product and to mix the said product, but, as its length is clearly greater than the width of the flexible pouch, it cannot be displaced to any significant degree.

The screen 6 remains in its position and cannot move into another position in which its median plane (12) would be perpendicular to the longitudinal axis of the pouch.

The longitudinal elements 61 are oriented substantially in the flow direction (11) of the product towards the head 4, i.e. vertically according to the representation of FIG. 1. These elements 61 define channels 7 oriented in the general flow direction (11) of the product. The channels 7 are continuous and free of obstacles, as all of the transverse elements 62 pass above or below the elements 61.

The assembly 1 operates in the manner described hereinafter. When the user wishes to dispense the product contained in the flexible pouch 2, he presses the distributor head 4 so as to remove the product. As the product is dispensed, the flexible pouch 2 empties and the lateral walls draw together. The lateral walls are kept at a distance from one another by the screen 6 and the shaped channels 7 make it possible to pump out the product.

Figure 3:
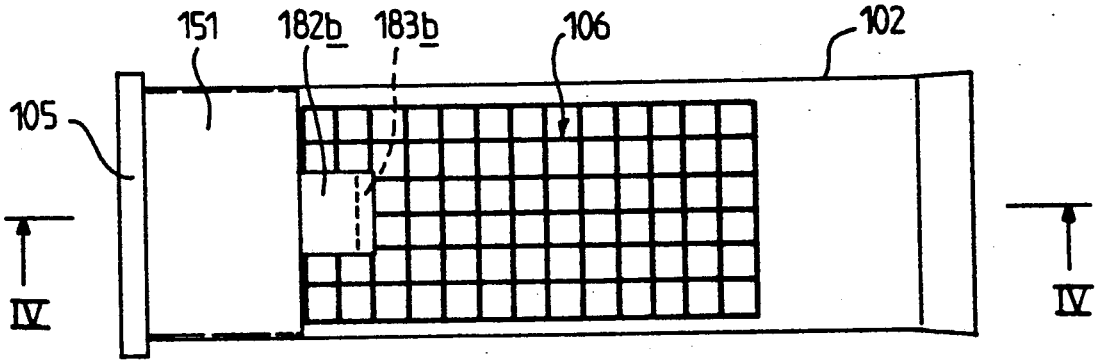
FIG. 3 is an elevation of a flexible pouch according to the invention, in which the screen is fixed.
Figure 4:
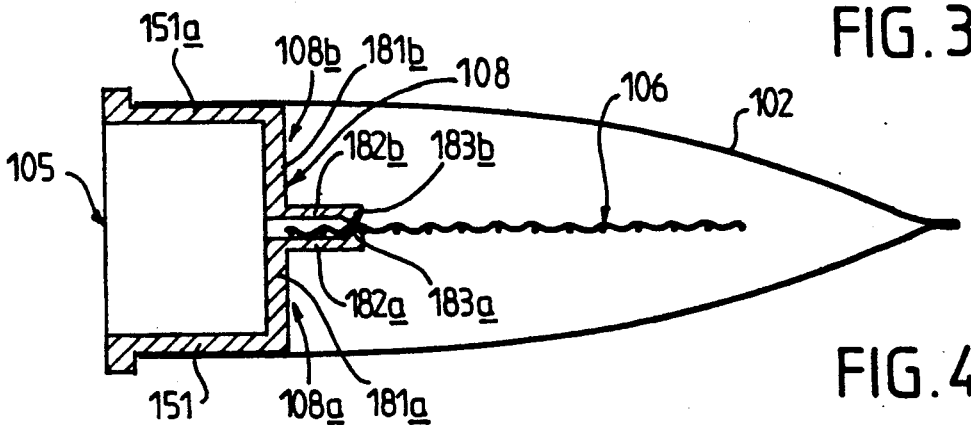
FIG. 4 is a sectional view along the line IV—IV of FIG. 3.

FIGS. 3 and 4 show the flexible pouch 102 of a dispenser assembly according to the invention. The flexible pouch 102 is fixed to a distributor head analogous to the one shown in FIG. 1. The distributor head is mounted on a cap 105, only the lower skirt 151 of which, to which the pouch is fixed by means of welding, is shown. This lower skirt consists of a cylindrical portion 151*a* on which the fixing device 108 is disposed. The latter consists of two symmetrical L-shaped legs 108*a* and 108*b*, the portion 181*a* or 181*b* fixed to the skirt 151 being perpendicular to the longitudinal axis of the flexible pouch and the portion 182*a* or 182*b* parallel to the axis being directed towards the bottom of the pouch 102. The free ends of these portions 182*a* and 182*b* each have a flange 183, the flanges 183*a* and 183*b* facing one another. The screen 106 is held between the legs 108*a* and 108*b*, more particularly between the flanges 183*a* and 183*b*.

Figure 5:
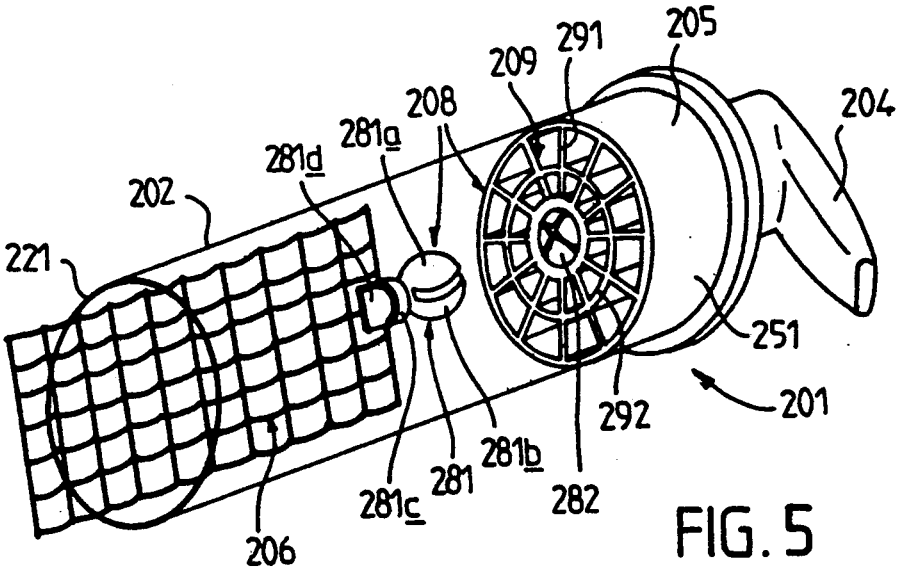
FIG. 5 is a partly sectional view and partly external view of an assembly according to the invention as the screen is being mounted.

FIG. 5 shows a dispenser assembly 201 during assembly. The assembly 201 comprises a flexible pouch 202 and a distributor head 204 mounted on a cap 205. The said cap 205 comprises a cylindrical skirt 251 to which the pouch 202 is fixed by means of welding. The pouch 202 contains a screen 206 and a device forming a capillary system 209. The screen is fixed to the device 209 by means of a fixing device 208 consisting of a hollow ball 281 associated with a spherical cap 282 provided with slots and disposed in the centre of the device forming the capillary system 209.

The ball 281 consists of two shells 281*a* and *b* fixed to an annular collar 281*c*. The said collar 281*c* has two legs 281*d* between which the screen 206 is fixed. The hollow ball 281 is mounted by snap engagement in the spherical cap 282. When the screen is mounted, the product can pass through the ball 281 and the cap 232 in the direction of the distributor head. According to the embodiment shown in FIG. 5, the device 209 forming the capillary system is fixed to the edge of the cylindrical skirt 251. It consists of a screen comprising radial elements 291 and an annular element 292. This device 209 complements the action of the screen 206, preventing the walls of the flexible pouch 202 from being sucked into the interior of the cap 205 and blocking the output orifice for the product of the container in the head 204.

For assembly of the dispenser according to the invention, the ball 281 is snapped into the cap 282. The flexible pouch 202 is filled with the product and the edge 221 of the flexible pouch is welded. The cap 205 is then fitted into the edge of a rigid enclosure (not shown) protecting the flexible pouch.

Figure 6:
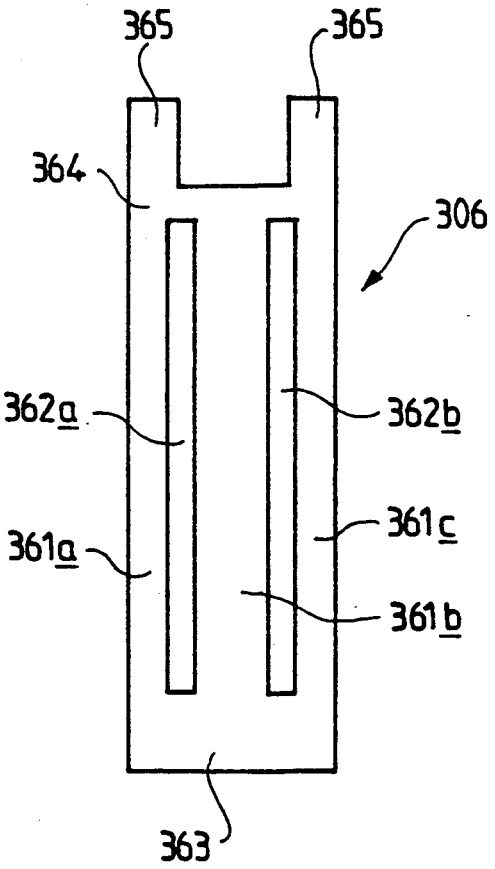
FIG. 6 is a front view of a semi-rigid component introduced into the pouch according to the second embodiment and FIG. 7 is a side view of this same component.
Figure 7:
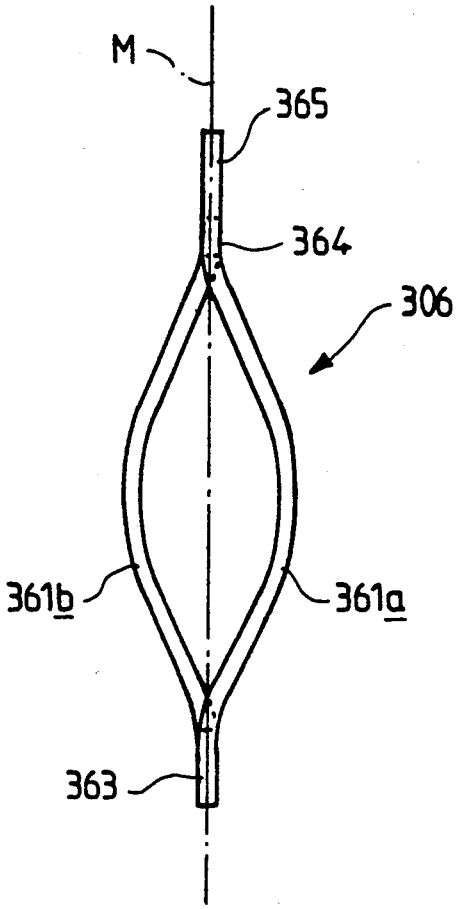

FIGS. 6 and 7 show a semi-rigid component 306 according to the second embodiment. The component 306 has a rectangular shape in projection over its median plane. It consists of three curved strips 361*a*, 361*b* and 361*c* separated by slots 362*a* and 362*b*. The strips 361*a*, 361*b* and 361*c* are connected at one of their ends to a flat transverse strip 363 and at their other end to another flat transverse strip 364 having two legs 365 for fixing at a fixing device for fixing to the outlet pipe for the product being dispensed (not shown).

The strips 361*a* and 361*c* are curved so as to project from one side of the median plane M and the centre strip 361*b* is curved so as to project systematically from the other side of the median plane M.

The component illustrated in FIGS. 6 and 7 comprises three strips. It should be noted that the number of strips can be increased.

I claim:

1. An assembly for dispensing a product in which a product to be dispensed is contained in a flexible pouch (2, 102, 202) fixed to a distributor head (4, 104, 204), the said flexible pouch (2, 102, 202) containing an internal component (6, 106, 206), the internal component being a semi-rigid component (6, 106, 206) having a median plane (12) which is substantially parallel to a flow direction (11) of the product towards the head (4, 104, 204), wherein the relative dimensions of the pouch and the component (6, 106, 206) are such that the component (6, 106, 206) remains in its position and cannot move into a position in which its median plane (12) would be perpendicular to the flow direction (11) of the product towards the head (4, 104, 204) and wherein the component (6, 106, 206) defines flow channels for the product being dispensed, said flow channels being directed towards the head (4, 104, 204), and wherein the internal component is a screen, said screen comprising longitudinal elements and transverse elements, said transverse elements being perpendicular to said longitudinal elements, wherein said longitudinal and transverse elements are rectilinear.

2. An assembly according to claim 1, wherein the internal component (6, 106, 206) only covers part of a median plane of the pouch.

3. An assembly according to claim 2, wherein the internal component (6, 106, 206) is shorter than the pouch (2, 102, 202).

4. An assembly according to claim 3, wherein the longitudinal elements (61) and transverse elements (62) are disposed in two parallel planes.

5. An assembly according to claim 4, wherein at least one of the longitudinal elements (61) and transverse elements (62) have corrugations (63) in planes perpendicular to the median plane of the screen.

6. An assembly according to claim 5, wherein the periphery of the screen is provided with beading.

7. An assembly according to claim 2, wherein the longitudinal elements (61) and transverse elements (62) are disposed in two parallel planes.

8. An assembly according to claim 7, wherein at least one of the longitudinal elements (61) and transverse elements (62) have corrugations (63) in planes perpendicular to the median plane of the screen.

9. An assembly according to claim 8, wherein the periphery of the screen is provided with beading.

10. An assembly according to claim 1, wherein the internal component (6, 106, 206) is shorter than the pouch (2, 102, 202).

11. An assembly according to claim 10, wherein the longitudinal elements (61) and transverse elements (62) are disposed in two parallel planes.

12. An assembly according to claim 11, wherein at least one of the longitudinal elements (61) and transverse elements (62) have corrugations (63) in planes perpendicular to the median plane of the screen.

13. An assembly according to claim 12, wherein the periphery of the screen is provided with beading.

14. An assembly according to claim 1, wherein the longitudinal elements (61) and transverse elements (62) are disposed in two parallel planes.

15. An assembly according to claim 14, wherein at least one of the longitudinal elements (61) and transverse elements (62) have corrugations (63) in planes perpendicular to the median plane of the screen.

16. An assembly according to claim 15, wherein the periphery of the screen is provided with beading.

17. An assembly for dispensing a product in which a product to be dispensed is contained in a flexible pouch fixed to a distributor head, the flexible pouch containing an internal component (306), the internal component being a semi-rigid component (306) and having a median plane (M) which is substantially parallel to the flow direction of the product towards the head, that the relative dimensions of the pouch and the component (306) are such that the component (306) is prevented from moving into a position in which its median plane (M) would be perpendicular to the flow direction of the product towards the head; wherein the component (306) defines flow channels for the product being dispensed, said channels being directed towards the head; and wherein the component (306) includes semi-rigid strips (361*a*, 361*b*, 361*c*) separated by slots (362*a*, 362*b*) and connected at their ends, the strips being curved at one side or the other of the median plane (M) of the component (306), two adjacent strips being curved in opposite directions.

18. An assembly according to claim 17, wherein the internal component (6, 106, 206) only covers part of a median plane of the pouch.

19. An assembly according to claim 18, wherein the internal component (6, 106, 206) is shorter than the pouch (2, 102, 202).

20. An assembly according to claim 19, wherein a capillary system (209) is fixed in the vicinity of an outlet pipe (13) between the semi-rigid component (206) and the pipe, perpendicular to the said semi-rigid component (206).

21. An assembly according to claim 18, wherein a capillary system (209) is fixed in the vicinity of an outlet pipe (13) between the semi-rigid component (206) and the pipe, perpendicular to the said semi-rigid component (206).

22. An assembly according to claim 17, wherein the internal component (6, 106, 206) is shorter than the pouch (2, 102, 202).

23. An assembly according to claim 22, wherein a capillary system (209) is fixed in the vicinity of an outlet pipe (13) between the semi-rigid component (206) and the pipe, perpendicular to the said semi-rigid component (206).

24. An assembly according to claim 17, wherein a capillary system (209) is fixed in the vicinity of an outlet pipe (13) between the semi-rigid component (206) and the pipe, perpendicular to the said semi-rigid component (206).

25. An assembly according to claims 1 or 17, wherein the internal component (106, 206) is fixed to an outlet pipe (13) for the product by a fixing device (108, 208).

26. An assembly according to claim 25, wherein the fixing device (108, 208) is movable by flexing or rotating said fixing device.

27. An assembly according to claim 26, wherein the fixing device comprises a hollow ball (281).

28. An assembly according to claim 25, wherein the fixing device comprises a hollow ball (281).

* * * * *